US006106179A

United States Patent [19]

Kuo

[11] Patent Number: 6,106,179

[45] Date of Patent: Aug. 22, 2000

[54] DUAL COLOR LIPSTICK IN A SINGLE CASE

[76] Inventor: Chen-Hui Kuo, No. 191, Lu Tong Road, Ting Tsuo Li, Lu Kang Township, Chang Hua Hsien, Taiwan

[21] Appl. No.: 09/222,280

[22] Filed: Dec. 28, 1998

[51] Int. Cl.[7] ..... B43K 27/00

[52] U.S. Cl. ..... 401/30; 401/32

[58] Field of Search ..... 401/29, 30, 32, 401/33, 31

[56] References Cited

U.S. PATENT DOCUMENTS 3,266,465 8/1966 Ganz ..... 401/33
5,056,947 10/1991 Kubota et al. ..... 401/29

FOREIGN PATENT DOCUMENTS 61-22683 2/1996 Japan ..... 401/30

*Primary Examiner*—David J. Walczak
*Attorney, Agent, or Firm*—Harrison & Egbert

[57] ABSTRACT

A dual color lipstick in a single case including an outer tube, wherein the inside of the outer tube has a relatively oblique guide surface and an inner tube seat, wherein both sides of the inner tube seat have moving elements. When the inner tube seat is inserted into the outer tube, the V-shaped protrusion of each of the moving elements can contact intimately with the oblique guide surface. In addition, each of the moving elements is inserted into the casing of a top end of the inner tube seat and is further engaged with a receiving seat that receives the lipsticks at the top ends thereof.

1 Claim, 6 Drawing Sheets

DUAL COLOR LIPSTICK IN A SINGLE CASE

FIELD OF THE INVENTION

The present invention relates generally to lipstick, and more particularly to dual color lipstick in a single case.

BACKGROUND OF THE INVENTION

Lipstick is a major cosmetic product and is used by women in many special occasions. There are many colors of lipstick available presently. Often, women will desire that the color of the lipstick match their dress color or their skin color.

Since various colors of lipstick are available, women often must carry various lipstick cases. If two colors of lipstick are to be applied, then two separate lipstick cases must be carried, opened and applied. This is an inconvenience.

SUMMARY OF THE INVENTION

The primary objective of the present invention is therefore to provide a single lipstick case which contains two colors of lipstick and which is free from the drawback of carrying additional lipsticks as described above.

In the present invention, the interior of the outer tube is provided with a relatively oblique guide surface and both sides of the inner tube seat are provided each with a moving element. So that while the inner tube seat is inserting into the outer tube, the V-shaped protrusion of the moving element can contact intimately with the oblique guide surface. In addition, each of the moving elements is engaged with a receiving seat that receives the lipstick. Therefore, the present invention provides two colors of lipstick in a single case which is easy to use and convenient to take out.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
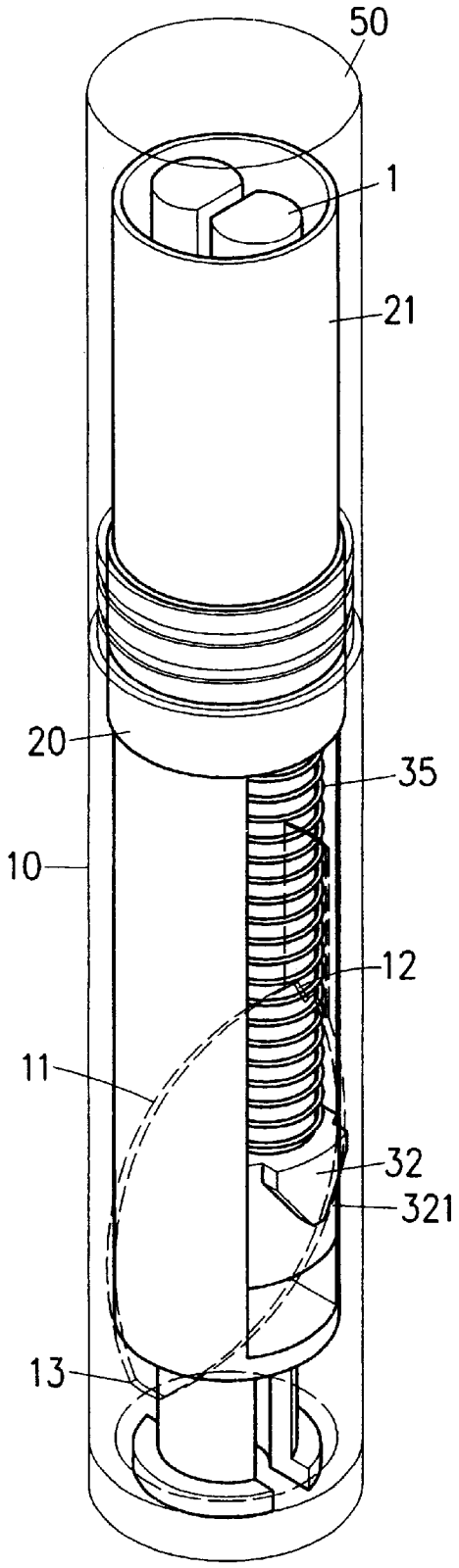
FIG. 1 shows a schematic view of the present invention.
Figure 2:
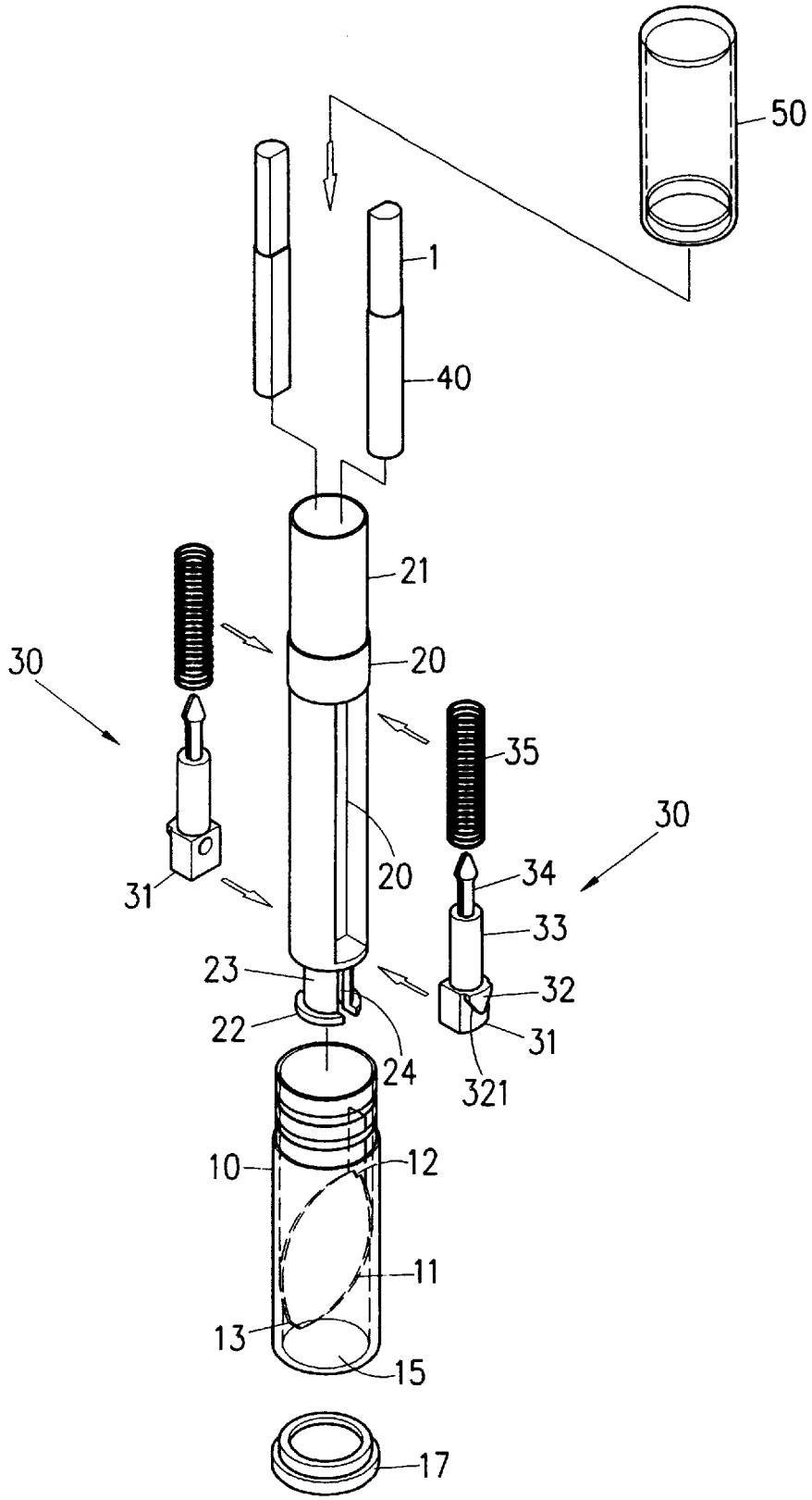
FIG. 2 shows an exploded view of the present invention.
Figure 3:
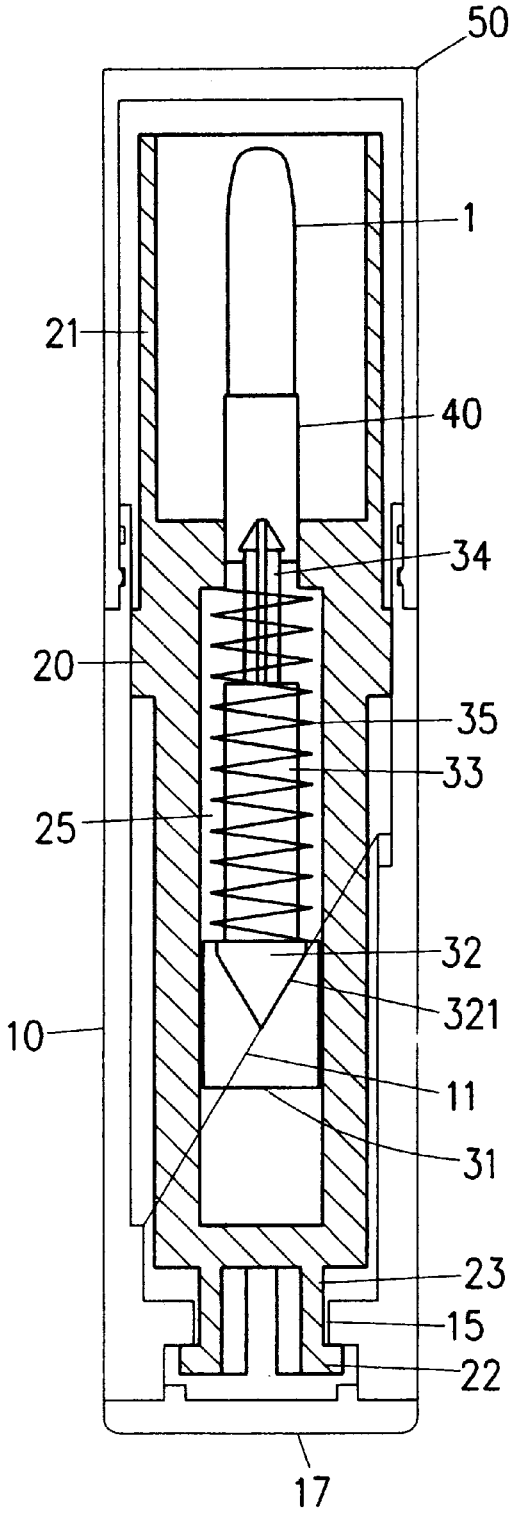
FIG. 3 shows a sectional view of the present invention.

As shown in FIGS. 1, 2, and 3, the present invention is comprised of an outer tube 10, an inner tube seat 20, two moving elements 30, two receiving seats 40, and a top cover 50.

The outer tube 10 is formed with an oblique guide surface 11 at an inner-wall thereof which forms V-shaped edge 12 at the joint of the two oblique guide surfaces 11 at the top end thereof, and further forms stop edge 13 at the bottom end thereof. The outer tube 10 is provided with a base cover 17 at one bottom end thereof.

The top end of inner tube seat 20 is a hollow casing 21 and the bottom end of inner tube seat 20 is a small diameter tube with a wedge-shaped sleeve 23 having a protruding ring 22. The center of the wedge shaped sleeve 23 is provided with a vertical slot 24. The bottom edge of casing 21 to the top edge of wedge shaped sleeve 23 has formed two vertical elongated troughs 25, 26 at opposite sides of the exterior of the inner tube seat 20. The top end of each vertical elongated communicates with casing 21.

The bottom end of two moving elements 30 forms a base seat 31 matching with the width of vertical elongated trough 25, 26 of inner tube seat 20. The base seat 31 is formed of a V-shaped protrusion 32 at the top end of the outer wall thereof, and further formed of a proper length rod body 33 at one top end thereof. The top end of rod body 33 is formed upwardly from a small diameter rod of plug rod 34 for engaging with a spring 35. The two moving elements 30 and the spring 35 are put together into each of the vertical elongated troughs 25, 26. In addition, the plug rod 34 inserts into the casing 21 of inner tube seat 20, at the same time, the inner tube seat 20 together with the moving element 30 and spring 35 are put into the outer tube 10, so as to let the bottom end of the wedge shaped 23 of inner tube seat 20 pass through the hole 15 for fixing the inner tube seat 20, and further to let each V-shaped protrusion 32 of the two moving elements 30 use an oblique edge 321 to contact intimately with the oblique guide surface 11 of the inner wall of outer tube 10.

The two receiving seats 40 are joined vertically into the casing 21 of inner tube seat 20, and each are engaged with the plug rod 34 of moving element 30 at one bottom end, each receiving seat has a lipstick 1 at one top end thereof.

The top cover 50 is engaged with the top end of outer tube 10 while the lipstick 1 is hidden inside the casing 21.

Figure 4:
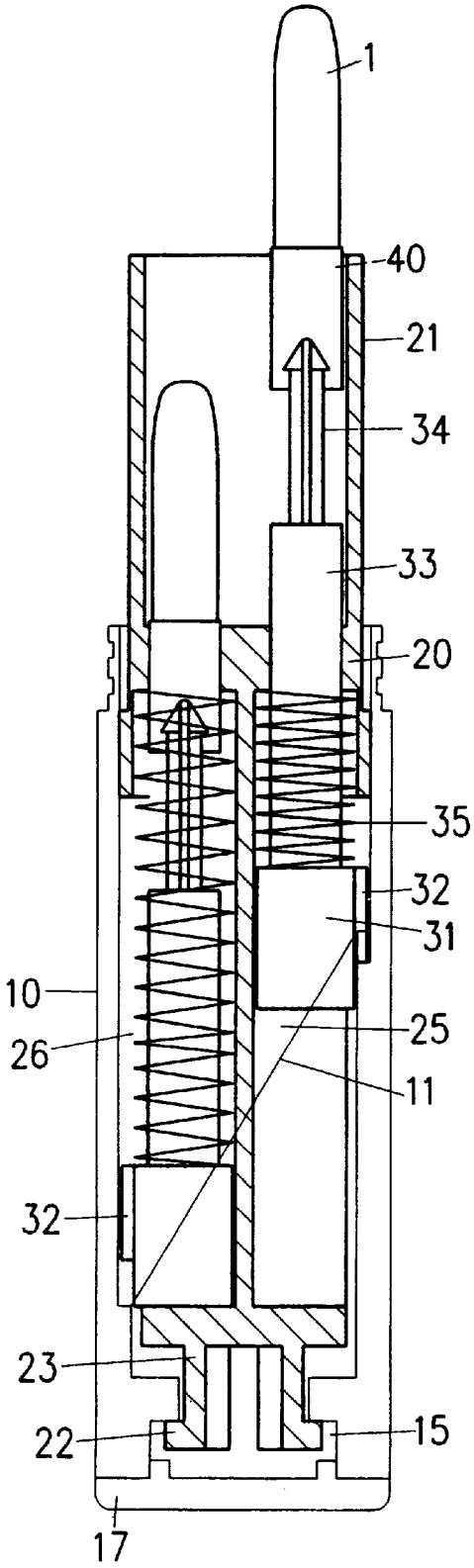
FIG. 4 shows another sectional view of the present invention.
Figure 5:
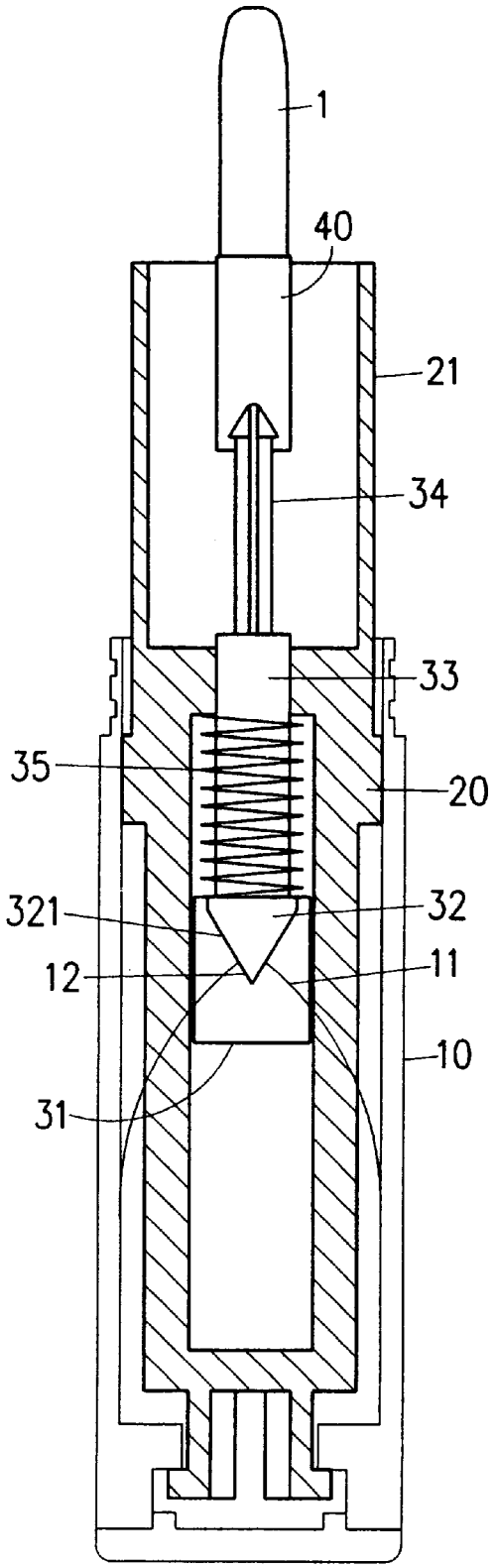
FIG. 5 shows a sectional view of the present invention in upward operation.
Figure 6:
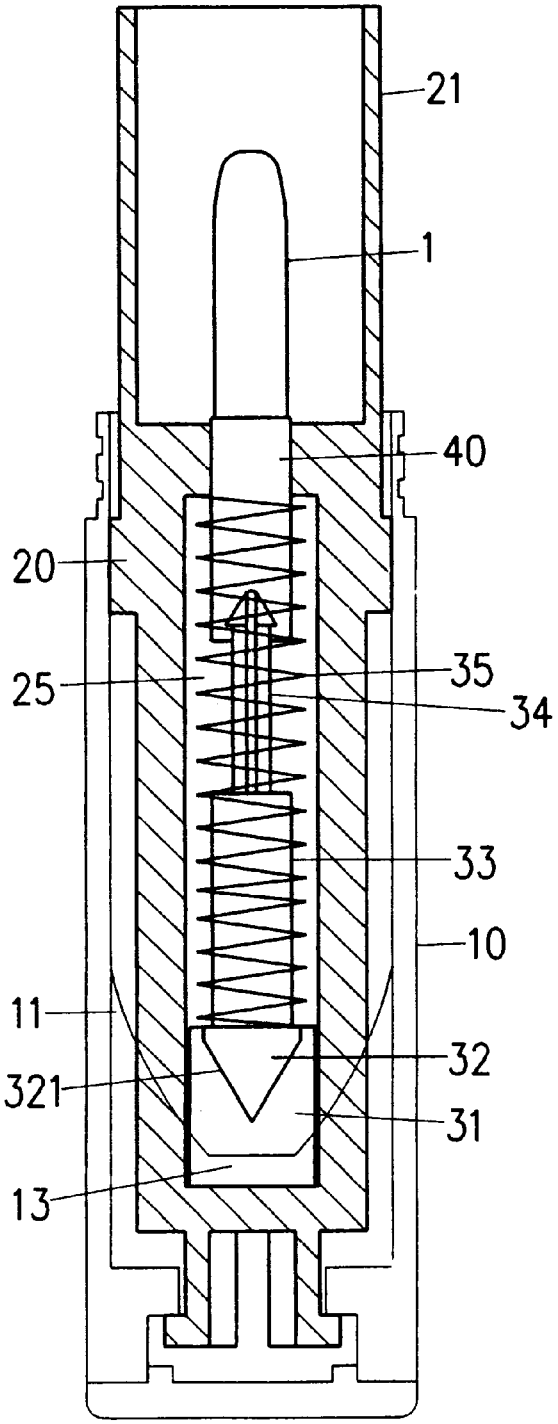
FIG. 6 shows another sectional view of the present invention in downward operation.

As shown in FIGS. 1 and 3, while the present invention is closed, each V-shaped protrusion 32 of the two moving elements 30 of the inner tube seat 20 aligns at generally the middle of oblique guide surface 11. When the user opens the top cover 50 and turns the outer tube 10, then the oblique guide surface 11 uses the turning action to guide the V-shaped protrusion 32 up by one of the two moving elements 30. According, the lipstick 1 is pushed upward. After the V-shaped protrusion 32 reaches to the top joint end of oblique guide surface 11, it is fixed in place by the limitation of V-shaped edge 12. In the present example, the lipstick 1 can be used to smear (as shown in FIGS. 4 and 5). If the user needs to use the other color lipstick 1, the outer tube 10 can be turned to the same side or the other side, so that the fixed V-shaped protrusion 32 of the V-shaped edge 12 is deviated from the fixed place. Thus, the other oblique guide surface 11 guides another V-shaped protrusion piece 32, so that the other lipstick 1 is pushed upward for use. In addition, due to the upward deviation of moving element 30 and shrinkage of spring 35, when the V-shaped protrusion 32 reaches the V-shaped edge 12, it will be fixed by the elasticity force of spring 35. As a result, the turning of outer tube 10 can push out the lipstick 1 to use. The present invention provides easy use and convenient operation.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. An apparatus for providing two lipstick colors comprising:

an outer tube having an oblique guide surface formed on an inner wall thereof, said oblique guide surface defining a V-shaped edge at a top end thereof, said oblique guide surface having a stop edge at a bottom thereof;

a base cover affixed to a bottom of said outer tube;

an inner tube seat having a hollow casing affixed at a top thereof said inner tube seat having a wedge-shaped sleeve at a bottom thereof said wedge-shaped sleeve having a protruding ring formed at a bottom thereof, said wedge-shaped sleeve having a vertical slot extending therealong, said inner tube seat having a pair of vertical elongated troughs extending from said wedge-shaped sleeve to said hollow casing, said pair of vertical elongated troughs formed on opposite sides of said inner tube seat, each of said pair of vertical elongated troughs communicating with an interior of said hollow casing;

two moving elements each formed with a base seat at a bottom end thereof, each said base seat receivable within a respective trough of said pair of vertical elongated troughs, each said base seat having a V-shaped protrusion formed at a top of an outer wall thereof, each of said two moving elements having a rod body extending upwardly from said base seat, each said rod body having a plug rod extending upwardly therefrom, each said plug rod having a diameter smaller than a diameter of said rod body, each said rod body and said plug rod engaging a respective spring, said two moving elements respectively received within said pair of vertical elongated troughs, each said plug rod extending into said interior of said casing, said inner tube seat and said two moving elements being received within said outer tube, each said V-shaped protrusion directly contacting said oblique guide surface;

two lipstick receiving seats positioned vertically into said hollow casing of said inner tube seat, each of said two lipstick receiving seats respectively engaged at a bottom end thereof with said plug rod, each of said two lipstick receiving seats respectively adapted to receive a lipstick at a top end thereof; and a top cover detachably engaged with a top end of said outer tube.

* * * * *